US010053824B2

(12) United States Patent
Jacob et al.

(10) Patent No.: US 10,053,824 B2
(45) Date of Patent: Aug. 21, 2018

(54) ROAD CONSTRUCTION MACHINE, PARTICULARLY A PAVING MACHINE OR CHARGING MACHINE

(71) Applicant: Dynapac GmbH, Wardenburg (DE)

(72) Inventors: Anup Jacob, Hamburg (DE); Jens Lübben, Varel (DE)

(73) Assignee: Dynapac GmbH, Wardenburg (DE)

( * ) Notice: Subject to any disclaimer, the term of this patent is extended or adjusted under 35 U.S.C. 154(b) by 0 days.

(21) Appl. No.: 15/533,552

(22) PCT Filed: Sep. 2, 2016

(86) PCT No.: PCT/EP2016/001485
§ 371 (c)(1),
(2) Date: Jun. 6, 2017

(87) PCT Pub. No.: WO2017/041881
PCT Pub. Date: Mar. 16, 2017

(65) Prior Publication Data

US 2018/0002874 A1 Jan. 4, 2018

(30) Foreign Application Priority Data

Sep. 7, 2015 (DE) ..... 10 2015 011 446

(51) Int. Cl.
*E01C 19/48* (2006.01)

(52) U.S. Cl.
CPC ..... *E01C 19/48* (2013.01)

(58) Field of Classification Search
CPC ..... E01C 19/48
(Continued)

(56) References Cited

U.S. PATENT DOCUMENTS 9,580,875 B1 * 2/2017 D'Ascanio ..... E01C 19/48
9,708,779 B2 * 7/2017 Brown ..... E01C 19/48
(Continued)

FOREIGN PATENT DOCUMENTS

DE 9315878 U1 2/1995
DE 102013216374 A1 2/2015
(Continued)

OTHER PUBLICATIONS

Deutsches Patent—Und Markenamt (German Patent and Trademark Office), Recherchebericht (search in a related application), Aug. 16, 2016.

(Continued)

*Primary Examiner* — Raymond W Addie
(74) *Attorney, Agent, or Firm* — Laurence P. Colton; Smith Tempel Blaha LLC

(57) ABSTRACT

A road building machine wherein the danger of material falling out as the supply container is loaded is avoided. For this it is proposed that the container halves each have at least one shield which can be moved away as the container halves are folded up. Road building machines, more particularly road pavers and feeders are supplied with road building material from trucks, and, in order to receive the road building material the road building machines have supply containers with two movable container halves, and, when the supply container is filled, the invention helps prevents road building material from falling out from the supply container.

16 Claims, 4 Drawing Sheets

(58) Field of Classification Search
USPC ..... 404/101, 105, 118
See application file for complete search history.

(56) References Cited

U.S. PATENT DOCUMENTS

| | | | | |
|---|---|---|---|---|
| 2015/0132058 | A1* | 5/2015 | Anderson | E01C 19/48 404/84.05 |
| 2016/0040368 | A1* | 2/2016 | Frelich | E01C 19/48 404/110 |
| 2016/0060823 | A1* | 3/2016 | Erdtmann | E01C 19/48 404/110 |
| 2016/0108585 | A1* | 4/2016 | Blank | E01C 19/002 404/110 |
| 2016/0194838 | A1* | 7/2016 | Amstutz | E01C 19/48 404/83 |
| 2017/0356140 | A1* | 12/2017 | Neumann | E01C 19/48 |

FOREIGN PATENT DOCUMENTS

| | | | |
|---|---|---|---|
| EP | 1596007 | A1 | 11/2005 |
| EP | 2492396 | A1 | 8/2012 |
| JP | H0748810 | A | 2/1995 |
| JP | 2001020214 | A | 1/2001 |

OTHER PUBLICATIONS

WIPO, International Search Report (on the parent application), dated Oct, 201, 2016.
European Patent Office, Transcript of interview regarding newly cited patent reference (with machine translation), Apr. 17, 2018.

* cited by examiner

ROAD CONSTRUCTION MACHINE, PARTICULARLY A PAVING MACHINE OR CHARGING MACHINE

STATEMENT OF RELATED APPLICATIONS

This application is the National Phase of and claims priority on and the benefit of International Application No. PCT/EP2016/001485 having an international filing date of 2 Sep. 2016, which claims priority on and the benefit of German Patent Application No. 102015011446.8 having a filing date of 7 Sep. 2015.

BACKGROUND OF THE INVENTION

Technical Field

The invention relates to a road building machine, more particularly a road paver or a feeder, having a chassis with a preferably driven undercarriage, with at least one supply container assigned to the chassis for receiving road building material, wherein the supply container has two container halves which can be unfolded and folded up relative to one another, and with at least one conveyor for discharging the road building material from the supply container.

Prior Art

Road building machines, more particularly road pavers and feeders, are supplied with road building material by way of example from a truck or other transport means. Road pavers serve to produce road coverings of asphalt or another road building material such as by way of example concrete. Feeders serve to supply the road paver with road building material. Trucks or the like tip the road building material either directly into a supply container or bunker, or into a trough of the road paver or into a supply container of the feeder which then transports the material further on to a road paver, more particularly into a supply container of the road paver. Road pavers for simultaneously producing several layers of a road covering have several supply containers for different road building materials.

As is known the supply containers have two container halves which can be folded up together and unfolded relative to one another. A conveying member is arranged in an apex area where the two container halves are connected to an undercarriage or chassis, and transports the road building material from the supply container against a production direction of the road building machine to a paving screed or to a further conveying member.

For transporting the road building machine or for the case where only a very little road building material is still in the supply container it is proposed that the container halves are folded up together. In order to fill or receive the road building material the container halves are unfolded in order to maximize the sump capacity or receptacle space of the supply container. In this situation the container halves protrude widely beyond the external dimensions of the chassis.

So that the two container halves can be folded up together the side walls of the container halves facing the chassis normally have slopes or recesses which correspond with one another and which are designed so that as they fold up the two side walls of the container halves do not collide with one another which would stop their movement. The drawback with this configuration of the side walls is that when filling the supply container with road building material the latter can fall out from the supply container over the side walls or slopes facing the chassis. The road building material which has fallen out then falls onto the already produced road covering and hardens. The falling road building material can furthermore fall onto the substrate which has not yet been finished and impedes the further production process. Furthermore the falling road building material can block or even destroy sensor elements or other mechanisms.

BRIEF SUMMARY OF THE INVENTION

The object of the invention is therefore to provide a road building machine, more particularly a road paver or feeder, in which when loading the supply container the danger of the road building material falling out from the supply container is avoided.

A road building machine, more particularly a road paver or feeder for achieving this object is a road building machine, more particularly a road paver or feeder, having a chassis with a preferably driven undercarriage, with at least one supply container assigned to the chassis for receiving road building material, wherein the supply container has two container halves which can be unfolded and folded up relative to one another, and with at least one conveyor for discharging the road building material from the supply container, characterized in that the container halves each have at least one shield which can be moved away as the container halves are folded up. According to this it is proposed that the container halves each have at least one shield which can be moved away as the container halves are folded up. The shields can then be configured as plates or plate-like flaps. The road building material is prevented from falling out from the supply container by the shields according to the invention.

The shields are preferably each arranged on a side wall facing the chassis, more particularly an outside surface of the side wall, of the container halves. The shields are thus arranged between the chassis and the side walls of the container halves. The sump capacity of the storage container is not reduced by this arrangement of the shields outside of the receptacle space of the container halves.

With an advantageous configuration of the road building machine it is proposed according to the invention that the shields are connected to the container halves so as to be freely movable, preferably transversely to the production direction of the road building machine. Thus the shields have just one degree of freedom transversely to the conveying direction of the road building material. Whereas the freedom of movement of the shields parallel to the conveying direction of the road building material is strictly limited or not provided.

More particularly it can be proposed that as the container halves are unfolded the shields are movable in areas projecting beyond the side walls of the container halves and/or as the container halves are folded up the shields can be moved out from this area. Thus as the container halves are unfolded the shields are pivoted, pushed, pressed or the like, straight into the recesses or into the freely exposed area of the side walls. Whereas when the container halves are folded up just this section or recess of the side walls of the container halves becomes free again for collision-free folding. This movement takes place purely by gravity, that is, that no further drives are required. The shields follow their movement through gravity, conditioned by their weight. This is particularly advantageous since no further drives, actuators or the like are required. It is however also conceivable that the shields can be moved by a mechanical, electrical, hydraulic or similar drive.

According to the invention it is proposed that the shields are suspended from the container halves on the side walls, more particularly by a corner area, swinging about an axis.

The shields are preferably formed as triangles, but can however also have any other rectangular or polygonal shape. Since the shields are suspended freely rotatable by a corner area on the outer face of the side wall, as the container halves are folded up and unfolded the shield rotates about the axis of rotation, namely first so that the centre of gravity of the shield is always located underneath the axis of rotation.

Furthermore it can preferably be proposed that at least two bolts, more particularly two static bolts, are arranged on the chassis, more particularly on a chassis wall, wherein each shield is assigned at least one bolt on the chassis wall. The bolts can also be pin-like or a different type of projection. The bolts can be correspondingly attached to the chassis depending on the requirements and external conditions. The bolts are attached each time fixedly to the chassis and do not move when the container halves are being unfolded or folded up. The bolts preferably have a rounded area which interacts with the side edges of the shields. More particularly the invention can propose that the bolts are arranged on the chassis so that at least when the container halves are being unfolded the shields move into contact with the bolt, and the shields can be moved by the bolts from a suspended position into a position resting on the bolts. As the container halves are unfolded a side edge of the shield moves into contact with the bolt. Since the shield is connected to the container half via the axis of rotation and continues to rotate about the axis through the movement of the container halves, the shield is drawn over the bolt. Since a corner area of the shield is connected rotatably to the container half, the shield moves from the practically vertical basic position into a rather horizontal position or end position. The shield is thus held by the axis of rotation and the bolt. Through this "drawing of the shield over the bolt" the shield is moved into the previously free recess of the side face of the container half. During unfolding, the shield is thus moved by the bolt out from a suspended counterpoised position. This movement is also conditioned solely by gravitational force, for which no further drives are required.

At least one stop is preferably mounted on the side walls, more particularly on the outside faces of the side walls of the container halves. These stops enter into contact with a side edge of the shields as the container halves are folded up together and thus force the shield over the counterpoised position in the direction of the other shield. The shields of the two container halves are moved by the stops practically so far up to one another that they touch. When the container halves are folded up the side edges of the shields first slip over the bolts until the contact is completely eliminated.

A further preferred exemplary embodiment of a road building machine can propose that a further stop is arranged on the chassis or on a chassis wall and in the folded-up position of the container halves serves as a spacer between the shields, more particularly restricts the pendulum movement of the shields. A gap thereby forms between the two side edges of the shields which have moved up to one another which prevents these from sticking together, as a result of the road building material which has remained adhering to the chassis wall.

According to a further advantageous configuration possibility for the road building machine it is proposed that the shields have on at least one side edge a border which is configured so that when the container halves are unfolded and folded up the edges of the border form a common plane with the edges of the shields which are arranged on the container halves. The container halves are each assigned at least one rail which is displaceable in elongated holes in order to produce a contact with the chassis wall. This serves on the one hand for sealing so that no road covering accidentally falls out from the supply container, but also on the other hand as a stripping aid so that no road building material settles on the chassis. The borders of the shields are now dimensioned and arranged precisely so that they correspond with these rails of the container halves and form a common sealing edge or stripping edge. This common edge also exists as the container halves are unfolded or folded up. The borders and the rails thus always form a common sealing or stripping edge irrespective of the pivoting angle of the shields. Thus at each moment in time it is ensured that no road building material leaves the supply container unplanned and road building material is scraped away from the chassis.

It is accordingly proposed according to the invention that the shields are arranged along the side walls of the container halves, more particularly the border of the shields, relative to the rails of the container halves so that as the container halves are unfolded and folded up no interspaces are formed between the shields and the side walls as well as between the borders, the rails and the chassis.

A road building machine, more particularly a road paver or feeder for achieving the object mentioned at the beginning is a road building machine, more particularly a road paver or feeder, having a chassis with a preferably driven undercarriage, with at least one supply container assigned to the chassis for receiving road building material, wherein the supply container has two container halves which can be unfolded and folded up relative to one another, and with at least one conveyor for discharging the road building material from the supply container, characterized in that at least two shields are mounted rotatably on a chassis wall facing the supply container, wherein at least one of the shields is assigned to each container half. According to this it is proposed that at least two shields are mounted for rotation on a chassis wall of the road building machine facing the supply container, wherein the container halves are each assigned at least one of the shields. The shields can then be configured as plates or plate-like flaps. Through the shields according to the invention the road building material is prevented from falling out from the supply container.

Furthermore it can preferably be proposed that the shields are suspended freely movable on the chassis wall transversely to a production direction of the road building machine to swing about an axis wherein when the container halves are unfolded the shields can be moved from a first position into a second positon relative to the side walls of the supply container. The shields are arranged between the chassis and the side walls of the container halves. The sump capacity of the supply container is not reduced through this arrangement of the shields outside of the receptacle space of the container halves. The shields have just one degree of freedom transversely to the conveying direction of the road building material. Whereas the freedom of movement of the shields parallel to the conveying direction of the road building material is strictly limited or not provided at all. The shields are preferably configured as triangles but can also have however any other rectangular or polygonal form. Since the shields are suspended freely rotating by a corner area on the chassis wall the shield is rotated about the axis of rotation as the container halves are folded up or unfolded, namely preferably initially so that the centre of gravity of the shield is always located underneath the axis of rotation.

More particularly the invention can further propose that at least two bolts, more particularly two static bolts are arranged on the container halves or on the side walls of the container halves, wherein each shield is assigned at least one bolt wherein the bolts are arranged on the side walls so that the shields move into contact with the bolts at least when the container halves are being unfolded, and the shields can be moved by the bolts from a first position into a second position. The bolts can be pin-like or a different type of projections. The bolts can be fastened correspondingly on the chassis depending on the requirements and external conditions. The bolts are fixed firmly on the chassis at any moment in time and do not move as the container halves are unfolded or folded up. The bolts preferably have a rounded area which interacts with the side edges of the shields. More particularly the invention can propose that the bolts are arranged on the chassis so that the shields enter into contact with the bolt at least when the container halves are unfolding and the shields can be moved by the bolts out from a suspended position into a position resting on the bolts. As the container halves are unfolding a side edge of the shield moves into contact with the bolts. Since the shield is connected to the chassis wall via the axis of rotation and continues to rotate about the axis through the movement of the container half, the shield is drawn over the bolt. Since a corner area of the shield is connected rotatably to the chassis wall the shield is moved from a basic position into an end position. The shield is thus held by the axis of rotation and the bolt. Through this "drawing the shield over the bolt", the shield is preferably moved into the previously free recess of the side face of the container half. This movement of the shields is conditioned solely by the force of gravity so that no further drives are required.

A further exemplary embodiment may propose that at least one stop is arranged on the chassis or chassis wall and in the folded-up state of the container halves serves as the spacer between the shields, more particularly restricts the pendulum movement of the shields. A gap is thereby formed between the two side edges of the shields which have been moved up to one another, whereby it is prevented that these stick together, as a result of road building material which has remained adhering to the chassis wall.

A particularly advantageous further development of the invention can propose that the shields have on at least one side edge a border which is configured so that as the container halves are unfolded and folded up the edges of the borders lie in a common plane with the edges of the rails which are arranged on the container halves, preferably that the shields are arranged along the side walls of the container halves, more particularly the borders of the shields, relative to the rails of the container halves, so that as the container halves are unfolded and folded up no interspaces are formed between the shields and the side walls as well as between the borders, the rails and the chassis wall. The container halves are each assigned at least one rail which are displaceable in elongated holes in order to produce a contact with the chassis wall. This serves on the one hand as a seal, so that no road covering falls accidentally out of the supply container, but also as a stripping aid, that no road building material settles on the chassis. The borders of the shields are now dimensioned and arranged precisely so that they correspond with these rails of the container halves and form a common sealing edge or scraping edge. This common edge also exists when unfolding or folding up the container halves. The borders and the rails thus always form a common sealing or sealed edge irrespective of the pivoting angle of the shields. Thus it is ensured at each moment in time that no road building material leaves the supply container unplanned and road building material is scraped away from the chassis.

It is accordingly proposed according to the invention that the shields are arranged along the side walls of the container halves, more particularly the border of the shields, relative to the rails of the container halves so that as the container halves are unfolded and folded up no interspaces are formed between the shields and the side walls as well as between the borders, the rails and the chassis.

BRIEF DESCRIPTION OF THE DRAWINGS

A preferred exemplary embodiment of the invention will now be explained in further detail below with reference to the drawing. In the drawings.

DETAILED DESCRIPTION OF PREFERRED EMBODIMENTS

Figure 1:
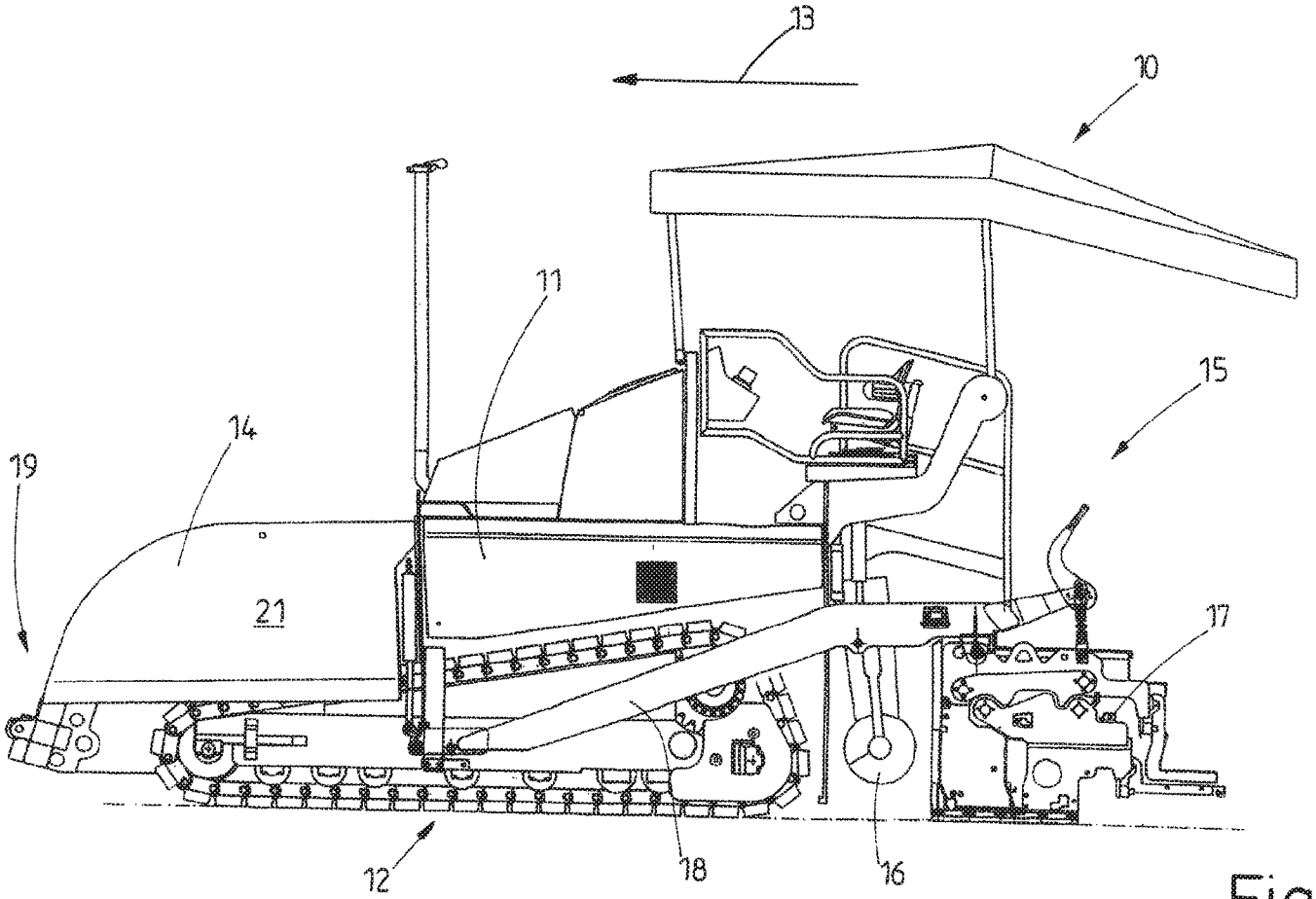
FIG. 1 shows a side view of a road paver.

The present invention is directed to a road building machine, more particularly a road paver 10 or feeder having a chassis (25) with a preferably driven undercarriage (12), with at least one supply container (14) assigned to the chassis (25) for receiving road building material, wherein the supply container (14) has two container halves (20, 21) which can be unfolded and folded up relative to one another, and with at least one conveyor (24) for discharging the road building material from the supply container (14). Even if a road paver 10 is shown in FIG. 1, the subject of the invention, more particularly the subjects of FIGS. 2 to 7, can likewise be transferred to a feeder, not shown. Using the illustration of the road paver 10 in FIG. 1 a description is only provided by way of example as to how the invention is connected to the manufacturing process of a road covering.

The road paver 10 illustrated in FIG. 1 serves to produce road coverings. The road paver 10 preferably serves to produce so-called blacktop, namely road coverings of asphalt. The road paver 10 can however also be used to produce road coverings of other materials, such as by way of example concrete.

The road paver 10 is a self-drive vehicle. For this it has a central drive unit 11 which has by way of example an internal combustion engine which has hydraulic pumps for supplying hydraulic motors and where applicable a generator for producing energy for electrical drives or heaters.

The road paver 10 furthermore has a drive undercarriage 12 which in the illustrated exemplary embodiment is configured as a caterpillar track mechanism. The road paver 10 can however also be provided with a wheel/roller carriage. The drive undercarriage 12 is driven by the drive unit 11 so that the road paver moves forwards in the production direction 13 to produce the road covering.

Seen in the production direction 13 a trough-like supply container 14, also called a bunker, is arranged in front of the drive undercarriage 12. The supply container 14 holds a supply of the material which serves to produce the road covering. The still hot road building material is transported from the supply container 14 by a conveying unit 24, formed by way of example as a scraper conveyor, against the production direction 13 to the rear end 15 of the road paver 10. The rear end 15 of the road paver 10 is located behind the drive undercarriage 12 and the drive unit 11, seen in the production direction 13.

At the rear end 15 of the road paver 10 there is a spreading auger 16 and at a distance behind this a paving screed 17. The spreading auger 16 and the paving screed 17 are capable of moving up and down. For this purpose the paving screed 17 is suspended from support arms 18. The support arms 18 are mounted for pivotable movement on the drive undercarriage 12 of the road paver 10. Hydraulic cylinders or the like pivot the support arms 18 in order to lift and lower the paving screed 17.

Figure 2:
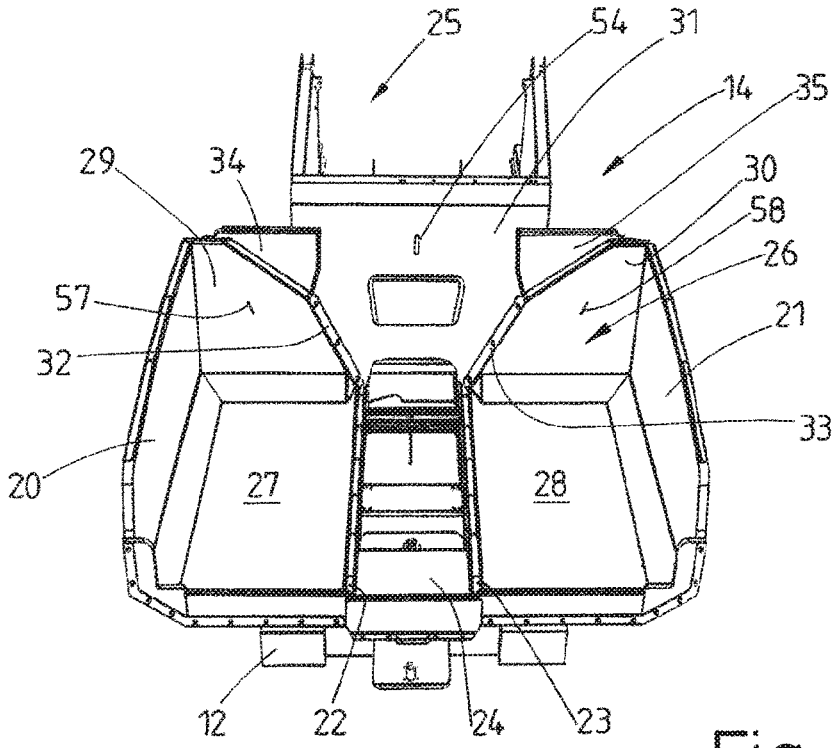
FIG. 2 shows a perspective view of a supply container.

In order to supply the road paver 10 or supply container 14 with road building material a truck (not shown) backs up against the end 19 of the road paver 10 and pours the road building material into the supply container 14. So that the sump capacity of the supply container 14 has maximum size, two container halves 20, 21 of the supply container 14 are unfolded (FIG. 2). The container halves 20, 21 then turn about axes of rotation 22, 23 which are arranged above the drive undercarriage 12. The area between the container halves 20, 21 and the axes of rotation 22, 23 provides a free view of the conveying unit 24 which is configured by way of example as a scraper conveyor. As already mentioned above, the road building material in the case of a road paver 10 is supplied to the paving screed 17 through this conveying unit 24. In the event that the supply container 14 is assigned to a feeder, the conveying unit 24 supplies the road building material to a further conveyor or directly into a supply container 14 of a further road building machine.

Both the drive unit 11, the drive undercarriage 12, the support arms 18 and also the supply container 14 are assigned to the vehicle chassis or also chassis 25 of the road paver 10.

The container halves 20, 21 together enclose a receptacle space 26 for the road building material. The individual container halves 20, 21 each have a base 27, 28 which is connected both to the axes of rotation 22, 23, and also each to two further side walls. The side walls 29, 30 positioned in the production direction 13 at the rear parts of the container halves 20, 21 directly border a chassis wall 31. The side walls 29, 30 are configured so that when folding up the receptacle space 26 can be minimized without the side walls 29, 30 colliding with one another.

So that no road building material falls between the side walls 29, 30 and the chassis wall 31, the side walls 29, 30 are assigned rails 32, 33. These rails 32, 33 can be moved in the production direction 13 so that they form a sealing contact with the chassis wall 31. The rails 32, 33 serve moreover to scrape off road building material which is adhering to the chassis wall 31 as the container halves 20, 21 are folded up.

According to the invention the side walls 29, 30 have shields 34, 35. These shields 34, 35 can be configured as plate-like flaps or as simple plates. The shields 34, 35 illustrated here have a triangular shape but can also have any other polygonal or any geometric shape.

According to the present invention the shields 34, 35 can be mounted both on the side walls 29, 30 of the supply container 14 and also on a chassis wall 31 of the chassis 25. The embodiment is shown below by way of example in which the shields 34, 35 are installed on the side walls 29, 30.

Figure 3:
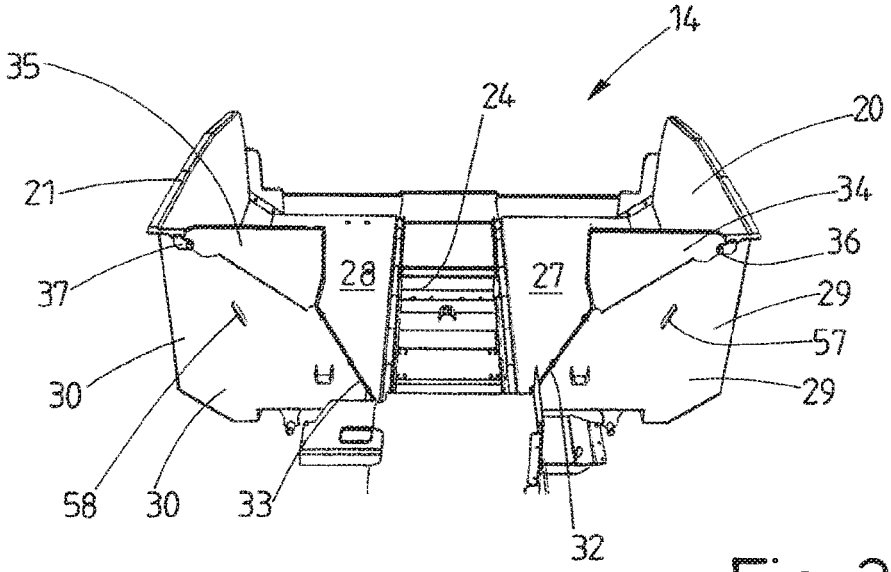
FIG. 3 shows a perspective rear view of the supply container.

FIG. 3 shows a rear view of the container halves 20, 21, seen in the production direction 13. It can be seen here that the shields 34, 35 are attached to the side walls 29, 30 movably, or rotatably about the axes 36, 37. According to the present invention the shields 34, 35 shown here are assigned to the side walls 29, 30 so that they are freely movable, more particularly swinging about the axes 36, 37. When the container halves 20, 21 are in their unfolded position as shown in FIG. 3, the shields 34, 35 are held in their horizontal position by bolts 38, 39 (not shown). In this position the shields 34, 35 just cover an otherwise free area between the side walls 29, 30 and the chassis wall 31. The shields 34, 35 thus prevent that in the unfolded state of the container halves 20, 21 or when receiving road building material this material falls down through the otherwise free opening between the side walls 29, 30 and the chassis wall 31, onto the substratum or the road paver 10.

Figure 4:
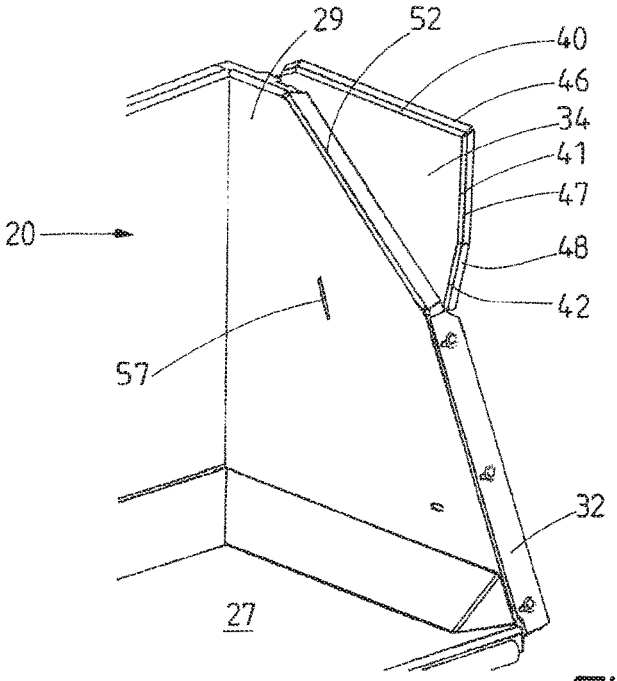
FIG. 4 shows a perspective view of a side wall of a container half.
Figure 5:
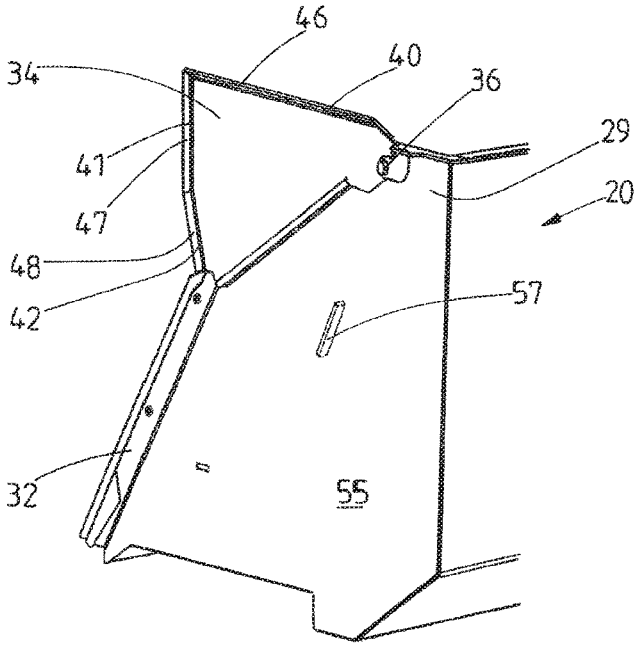
FIG. 5 shows a perspective view of the side wall of the container half.
Figure 6:
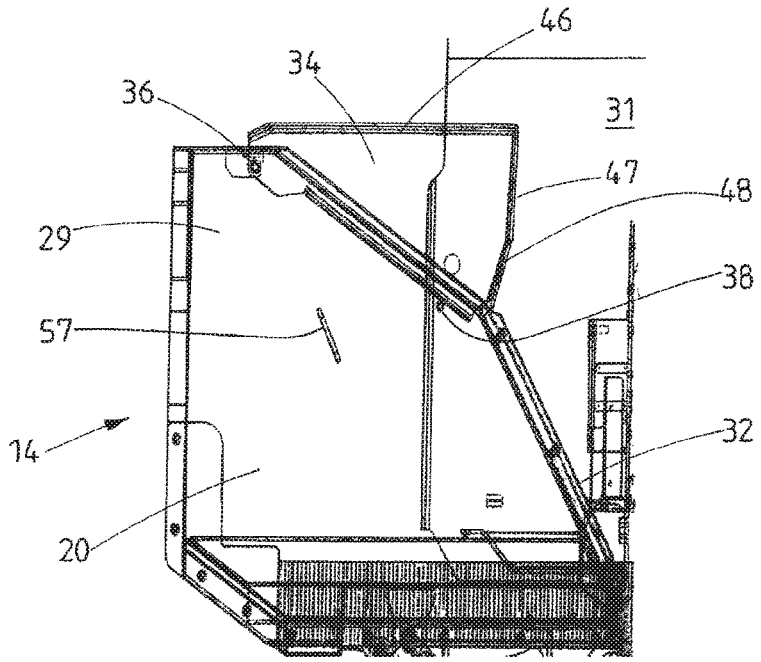
FIG. 6 shows a section through a container half in the unfolded position.

So that the shields 34, 35 in the position illustrated in FIG. 3 form a sealing action relative to the chassis wall 31, each side edge 40, 41, 42 of the shield 34 as well as each side edge 43, 44, 45 of the shield 35 are each assigned a border 46, 47, 48 and 49, 50, 51 respectively. The borders 46, 47, 48, 49, 50, 51 are measured just so that their widths together with the widths of the edges 52, 53 of the side walls 29, 30 correspond to the widths of the rails 32, 33. The rails 32, 33 together with the borders 46, 47, 48, 49, 50, 51 of the shields 34, 35 thus form a sealing edge or a scraper edge in respect of the chassis wall 31 (FIG. 4, FIG. 5). It is however also conceivable according to the invention that the shields 34, 35 have only one, two or more than three corresponding borders which undertake a similar function in interaction with the chassis wall 31 as the exemplary embodiment illustrated here.

Particularly when the container halves 20, 21 are being folded up the rails 32, 33 and the borders 46, 47, 48, 49, 50, 51 are moved along the chassis wall 31 and thus clean the chassis wall 31 of any road building material which may be remaining thereon. The road building material is properly scraped away from the rails 32, 33 and the borders 46, 47, 48, 49, 50, 51.

Figure 7:
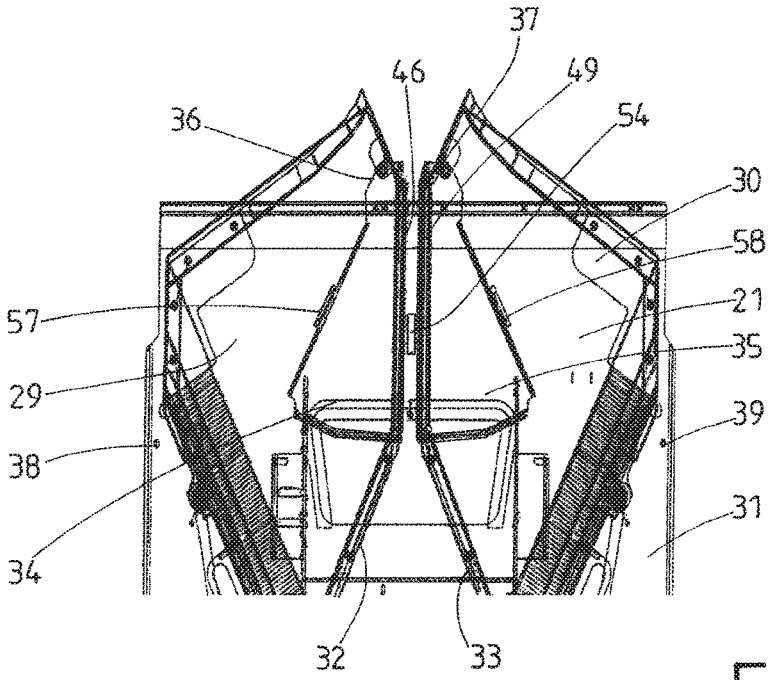
FIG. 7 shows a section through the supply container in the folded-up position.

In the folded-up state of the container halves 20, 21 the receptacle space 26 of the supply container 14 is minimized. This position of the container halves 20, 21 is furthermore particularly suitable for transporting the road paver 10 owing to the shorter width of the road paver 10 transversly to the production direction 13. In this position which is shown in FIG. 7 the shields 34, 35 hang downwards, held by the axes 36, 37. The side edges 40, 43 of the shields 34, 35 can be aligned parallel to the edges 52, 53 of the side walls 29, 30. The borders 46, 49 of the shields 34, 35 are in this position aligned opposite one another and are only separated from one another by a stop 54 which is arranged centrally on the chassis wall 31. This stop 54 has the result that the side edges 40, 43 of the shields 34, 35 do not contact one another and possibly become stuck to one another by residual road building material.

A stop 57, 58 is located on each of the outer faces 55, 56 of the side walls 29, 30. These stops 57, 58 on the side walls 29, 30 of the container halves 20, 21 slide the shields 34, 35 into their hanging position as the container halves 20, 21 are folded up so that the shields 34, 35 are fixed in their basic position illustrated in FIG. 7 by the stops 57, 58 and the stop 54. Thus as the container halves 20, 21 fold up the shields 34, 35 are only moved by the influence of the stops 57, 58 and gravity. It is however also conceivable that the shields 34, 35 are moved from their horizontal position into the hanging position—and back again—through drives, such as by way of example mechanical, electrical, hydraulic or other drives.

As the container halves 20, 21 are unfolded the shields 34, 35 again follow the effect of gravity and rotate about the axes 36, 37. So that the shields 34, 35 pass into the horizontal position illustrated in FIGS. 1 to 6 in order to avoid the loss of road building material, the chassis wall 31 is assigned the bolts 38, 39 already mentioned. During unfolding, the side edges of the shields 34, 35 move into contact with the bolts 38, 39. As the container halves 20, 21 continue to unfold, the shields 34, 35 are drawn over the bolts 38, 39 and are thus pushed or pivoted into their horizontal position illustrated by way of example in FIG. 6. Also with this movement no additional drives are necessary—but conceivable.

Thus as the container halves 20, 21 unfold, a previously free area between the side walls 29, 30 and the chassis wall 31 is closed by the shields 34, 35 and as the container halves 21, 22 fold up the shields are moved away so that the edges 52, 53 of the container halves 20, 21 are drawn together.

REFERENCE NUMERAL LIST

10 Road paver
11 Drive unit
12 Drive undercarriage
13 Production direction
14 Supply container
15 Rear end
16 Spreading auger
17 Paving screed
18 Support arm
19 Front end
20 Container half
21 Container half
22 Axis of rotation
23 Axis of rotation
24 Conveying unit
25 Chassis
26 Receptacle space
27 Base
28 Base
29 Side wall
30 Side wall
31 Chassis wall
32 Rail
33 Rail
34 Shield
35 Shield
36 Axis
37 Axis
38 Bolt
39 Bolt
40 Side edge
41 Side edge
42 Side edge
43 Side edge
44 Side edge
45 Side edge
46 Border
47 Border
48 Border
49 Border
50 Border
51 Border
52 Edge
53 Edge
54 Stop
55 Outside surface
56 Outside surface
57 Stop
58 Stop

What is claimed is:

1. A road building machine configured as a road paver (10) or feeder, comprising:

a chassis (25) with a driven undercarriage (12);

at least one supply container (14) assigned to the chassis (25) for receiving road building material, wherein the supply container (14) has two container halves (20, 21) configured to be unfolded and folded up relative to one another; and at least one conveyor (24) for discharging the road building material from the supply container (14);

wherein the container halves (20, 21) each have at least one shield (34, 35) which can be moved away as the container halves (20, 21) are folded up;

wherein the at least one shield (34, 35) is arranged on a side wall (29, 30) facing the chassis (25), wherein the at least one shield (34, 35) is connected to the container halves (20, 21) in a freely movable manner transversely to the production direction (13) of the road building machine.

2. The road building machine as claimed in claim 1, wherein the at least one shield (34, 35) is each arranged on the side wall (29, 30) facing an outside surface (47, 48) of the side wall (29, 30) of the container halves (20, 21).

3. The road building machine as claimed in claim 2, wherein, as the container halves (20, 21) are unfolded, the at least one shield (34, 35) is movable into areas projecting beyond the side walls (29, 30) of the container halves (20, 21) and/or, as the container halves (20, 21) are folded up, is movable out from these areas, wherein the at least one shield (34, 35) is suspended from the container halves (20, 21) by a corner region, to swing about an axis (36, 37).

4. The road building machine as claimed in claim 1, further comprising at least two static bolts (38, 39), wherein the bolts (38, 39) are arranged on the chassis (25) or a chassis wall (31) wherein at least one of the bolts (38, 39) is assigned to each of the at least one shield (34, 35).

5. The road building machine as claimed in claim 4, wherein the bolts (38, 39) are arranged on the chassis wall (31) such that the at least one shield (34, 35) moves into contact with the bolts (38, 39) at least as the container halves (20, 21) are unfolded, and the at least one shield (34, 35) is movable by the bolts (38, 39) out from a suspended position into a position resting on the bolts (38, 39).

6. The road building machine as claimed in claim 2, further comprising at least one stop (57, 58) arranged on the side walls (29, 30).

7. The road building machine as claimed in claim 6, wherein the at least one stop (57, 58) is arranged on outside surfaces (55, 56) of the side walls (29, 30), of the container halves (20, 21).

8. The road building machine as claimed in claim 6, wherein the at least one stop (57, 58) is arranged on outside surfaces (55, 56) of the container halves (20, 21) such that, as the container halves (20, 21) are folded up, the at least one shield (34, 35) moves into contact with the at least one stop (57, 58), and the at least one shield (34, 35) can thus be brought into a suspended starting position.

9. The road building machine as claimed in claim 8, further comprising an additional stop (54) arranged on the chassis (25) or a chassis wall (31), wherein, in the folded-up state of the container halves (20, 21), the additional stop (54) serves as a spacer between the at least one shield (34,35) such that the additional stop (54) restricts the pendulum movement of the at least one shield (34, 35).

10. The road building machine as claimed in claim 1, wherein each of the at least one shield (34, 35) has on at least one side edge (40, 41, 42) a border (46, 47, 48), the border (46, 47, 48) configured such that as the container halves (20, 21) unfold and fold up, the edges of the borders (46, 47, 48) lie in a common plane with the edges of rails (32, 33) which are arranged on the container halves (20, 21).

11. The road building machine as claimed in claim 10, wherein the at least one shield (34, 35) is arranged along the side walls (29, 30) of the container halves (20, 21), along the borders (46, 47, 48) of the at least one shield (34, 35), relative to the rails (32, 33) of the container halves (20, 21), such that as the container halves (20, 21) unfold and fold up, no interspaces are formed between the at least one shield (34, 35) and the side walls (29, 30) as well as between the borders (46, 47, 48), the rails (32, 33) and the chassis wall (31).

12. A road building machine configured as a road paver (10) or feeder, comprising:

a chassis (25) with a preferably driven undercarriage (12);

at least one supply container (14) assigned to the chassis (25) for receiving road building material, wherein the supply container (14) has two container halves (20, 21) which can be unfolded and folded up relative to one another;

at least one conveyor (24) for discharging the road building material from the supply container (14); and at least two shields mounted rotatably on a chassis wall (31) facing the supply container (14), wherein one of the at least two shields is assigned to each container half (20, 21).

13. The road building machine as claimed in claim 12, wherein the at least two shields are suspended freely movable on the chassis wall (31) swinging about an axis transversely to a production direction (13) of the road building machine, wherein as the container halves (20, 21) are unfolded, the at least two shields are movable from a first position into a second position relative to side walls (29, 30) of the supply container (14).

14. The road building machine as claimed in claim 13, further comprising at least two static bolts, wherein the bolts are arranged on the container halves (20, 21) or on the side walls (29, 30) of the container halves (20, 21), wherein each of the at least two shields is assigned at least one of the bolts, wherein the bolts are arranged on the side walls (29, 30) such that, at least as the container halves (20, 21) are unfolded, the at least two shields move into contact with the bolts (38, 39) and the at least two shields are movable from a first position into a second position by the bolts (38, 39).

15. The road building machine as claimed in claim 12, further comprising at least one stop arranged on the chassis (25) or the chassis wall (31), and, when the container halves (20, 21) are folded up together, the container halves (20, 21) serves as a spacer between the at least two shields, wherein the container halves (20, 21) restricts the pendulum movement of the at least two shields.

16. The road building machine as claimed in claim 13, wherein the at least two shields each have on at least one side edge a border which is configured such that, as the container halves (20, 21) unfold and fold up, the edges of the borders lie in a common plane with the edges of rails which are arranged on the container halves (20, 21) such that the at least two shields are arranged along the side walls (29, 30) of the container halves (20, 21), more particularly the borders of the at least two shields, relative to the rails of the container halves (20, 21) so that, as the container halves (20, 21) unfold and fold up, no interspaces are formed between the at least two shields and the side walls (29, 30) as well as between the borders, the rails and the chassis wall (31).

* * * * *